United States Patent [19]

Lipp

[11] 4,048,827

[45] Sept. 20, 1977

[54] APPARATUS FOR FORMING A LARGE DIAMETER PIPE

[76] Inventor: Xaver Lipp, Hohenstaufenstrasse 30, D 7090 Ellwangen, Jagst, Germany

[21] Appl. No.: 700,733

[22] Filed: June 28, 1976

[30] Foreign Application Priority Data

July 4, 1975 Germany ..... 2529925
Dec. 23, 1975 Germany ..... 2558454

[51] Int. Cl.[2] ..... B21C 37/12

[52] U.S. Cl. ..... 72/50; 226/189; 72/166; 72/168

[58] Field of Search ..... 228/146, 17.7, 17.5; 72/49, 50, 135, 180, 181, 106, 171, 168, 166, 173, 174, 175; 29/429; 164/282; 226/189

[56] References Cited

U.S. PATENT DOCUMENTS

| | | | |
|---|---|---|---|
| 3,144,071 | 8/1964 | Nash | 72/166 |
| 3,268,985 | 8/1966 | Smith | 29/429 X |
| 3,338,297 | 8/1967 | Foldessy | 164/282 X |
| 3,863,479 | 2/1975 | Lipp | 72/50 |
| 3,938,584 | 2/1976 | Meylan | 164/282 X |

*Primary Examiner*—Milton S. Mehr
*Attorney, Agent, or Firm*—Roylance, Abrams, Berdo & Kaul

[57] ABSTRACT

An apparatus for helically winding a strip of sheet metal into a large diameter pipe and connecting the edges of the strip by preforming and rabbeting. The edge bending for the rabbet is done in a preforming station and a rabbeting station in which the bends are sequentially and increasingly formed with multiple units at each station. Adjacent units are hinged and devices for adjusting the angular relationship between adjacent units are provided, including spacers and adjustable threaded devices. Gears permit driving multiple units at various adjustment angles.

11 Claims, 8 Drawing Figures

APPARATUS FOR FORMING A LARGE DIAMETER PIPE

This invention relates to an apparatus for the production of pipe having a large diameter and, more particularly, to a pipe in the nature of a silo formed from an elongated strip or ribbon of sheet metal.

This invention employs a machine for substantially continuously feeding a strip of sheet metal around a spiral path and shaping the adjacent edges of the metal so they they can be interconnected by rabbeting, the metal being passed through processing stations including a profiling station which preforms the edges and a rabbeting station which joins the preformed edges. Each of the processing stations has several processing units disposed in succession along the arcuate path through which the sheet metal is caused to pass. Each of the units has a pair of processing rollers, the rollers having suitable contours for accomplishing the preformaing and bending operations.

An object of the present invention is to provide an apparatus of this type wherein the processing units are mutually adjustable in order to change the bending radius of the sheet perpendicularly to and/or in the plane of the sheet so that the perpendicular bending serves the purpose of establishing the diameter of the pipe which is being produced and the bending in the plane of the metal sheet serves for limiting, and preferably for preventing, deviations from the diameter of the pipe which might occur as a result of tensions existing in the sheet metal which would cause an undesirable bending of the sheet metal in its plane.

Briefly described, the invention includes an apparatus for helically winding sheet metal to form a large diameter pipe including means for forming and interconnecting adjacent edges of the sheet by rabbeting, said means including a profiling station and a rabbeting station, each of the stations including a plurality of processing units and each of said units having pairs of processing rolls for forming said edges, said pairs of rools being disposed along an arcuate path, the units in each station being serially arranged to sequentially form said edges; drive means for driving said rolls; hinge means interconnecting adjacent ones of said units for relative pivotal adjustment about substantially parallel axes; and means connected to said units for adjusting the angular relationship between adjacent ones of said units.

The processing station can be adjusted by adjusting at least one of its processing units in relation to the adjacent processing unit and thus can be adapted to the sheet metal which is being processed in order to achieve a pipe having a cylindrical wall, i.e., corresponding to the diameter of the pipe which is to be produced. The drive for the processing rolls which are present in the individual processing units must be such that mutual adjustment of two adjacent processing units is possible. Because of the adjustable arrangement, sheets can be processed into pipes which in their plane are developed curved because of tensions, and which, without the corresponding adjustability of the processing station, would lead to undesirable changes in the diameter. The processing unit can also be adjusted additionally to variable diameters of the pipe to be produced. Since, in any case, the processing points of the rabbeting station must be adapted to the diameter of the pipe, an adjustability of the units therein is of particular advantage. In the absence of such adjustability of the rabbeting station, it would be necessary to select a rabbeting station which is fixedly adapted to a single pertinent diameter of the pipe to be formed.

In a preferred embodiment, the joint or hinge point between units is provided on the inside of the arc determined by the processing units of the processing station and the supporting and adjusting arrangement is disposed radially outside of the joint. It will be noted that the greater the spacing between the hinge location between adjacent units is from the adjusting arrangement, the finer and more precise is the adjustment of the desired bending radius of the sheet.

In one embodiment the adjusting arrangement includes a threaded spindle adjustable perpendicularly with respect to the pivot axis between unit, in which case the bending radius of the sheet can be changed in the plane of the sheet such that the tensions existing in the metal strip can be taken into consideration and compensation therefor can be made.

A further advantageous embodiment includes an adjusting arrangement with a rigid spacing element disposed between adjacent processing units and releasably attached to them.

In order that the manner in which the foregoing and other objects are attained in accordance with the invention can be understood in detail, particularly advantageous embodiments thereof will be described with regference to the accompanying drawings, which form a part of this specification, and wherein.

Figure 1:
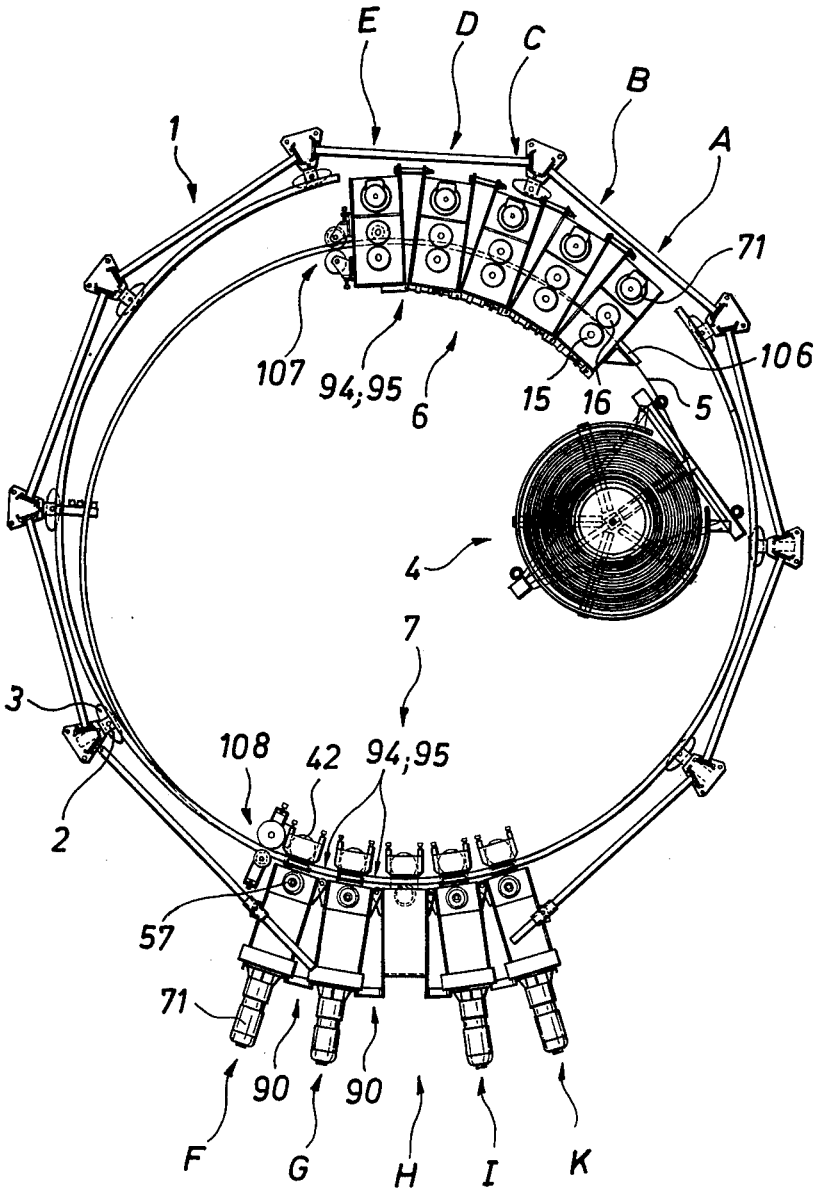
FIG. 1 is a plan view of a pipe-forming apparatus in accordance with the invention.
Figure 2:
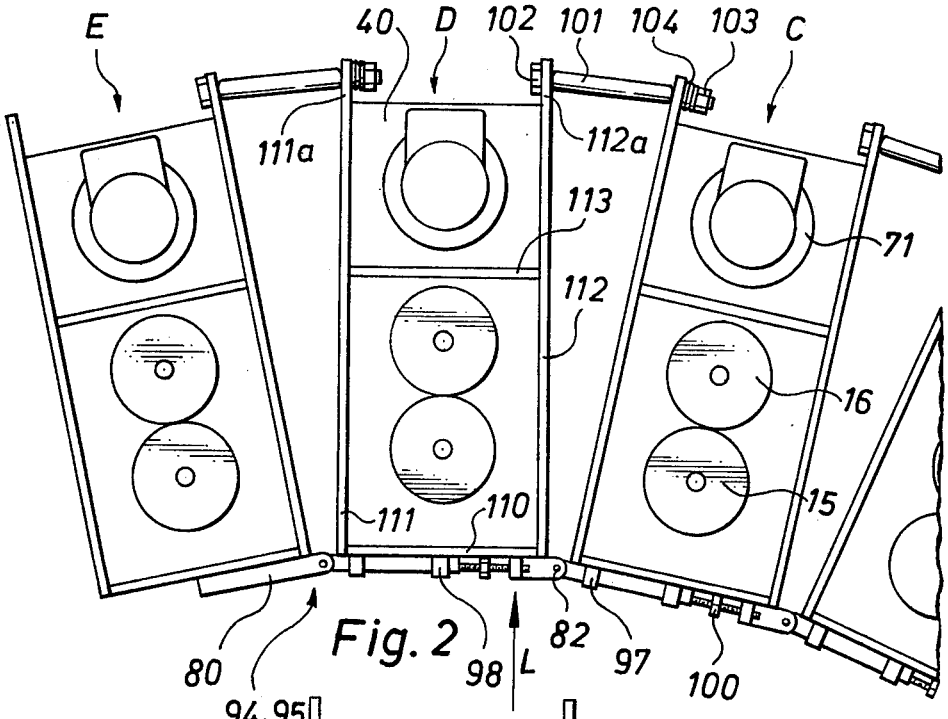
FIG. 2 is an enlarged partial view of a portion of the apparatus of FIG. 1.

As shown in FIG. 1, the apparatus for the production of a large diameter pipe in the nature of a silo includes an annular frame 1 having an upper ring and a lower ring. The two rings are connected with each other by columns and are segmentally formed of subdivided linear portions which are connected between columns. On the columns, supporting rolls 3 are rotatably mounted by means of pivotally mounted swiveling arms 2 which are pivotable about vertical axes, each swiveling arm carrying one supporting roll. A reel 4, which can conveniently be supported on the floor of the production area, is disposed within annular frame 1 and serves to support a roll of the sheet metal strip 5 from which the pipe will be formed. A profiling station indicated generally at 6 receives the metal strip from reel 4 and preforms the edges thereof, whereafter the strip is delivered to a rabbeting station indicated generally at 7 which is advantageously disposed more than 180° around frame 1 from the profiling station. The profiling station includes individual profiling units indicated generally at A, B, C, D and E, and the rabbeting station similarly includes individual rabbeting units F, G, H, I and K. Of these, units F, G, I and K are designed to be rabbeting units while H is a "no-load" unit. The operating positions of the rabbeting units are on the same diameter as the contacting portions of supporting rolls 3 while the operating positions of the profiling units lie inside of the circle defined by supporting rolls 3.

The annular frame 1, the reel 4, profiling station 6 and rabbeting station 7 can stand on the bottom or floor which in the final product, carries the silo which is being formed by using the apparatus of the invention. The profiling station 6 and the rabbeting station 7 are generally located on stands which are adjustable as to height and inclination by conventional devices.

Profiling station 6 serves for beveling of the two edges of strip 5 and rabbeting station 7 accomplishes the task of putting together two adjacent edges of the sheet which are arranged spirally one above the other. For molding the edges of the metal sheet, each of the profiling units A-E includes molding rolls of which only the upper molding rolls 15 and 16 can be seen in FIG. 1. The vertical shafts of the molding rolls are rotatably mounted and are fixedly attached to gears which interrelate the drive of the rolls. One of the shafts of the molding rolls of a processing unit can be driven by a chain coupled to a driving motor 71. Each of the profiling units A-E is housed in a housing 40 which has a vertical inside wall 110, two vertical lateral walls 111 and 112 which are parallel to each other and perpendicular to wall 110, and a back wall 113 disposed between roll 16 and the driving motor 71. The walls are connected with one another by means of a bottom wall and the housing 40 is covered on top, contrary to the illustration, so that only the axles of rolls 15 and 16 extend through the top cover. Walls 111 and 112 are slotted (not shown) to permit the strip 5 to enter and exit from each unit.

Figure 3:
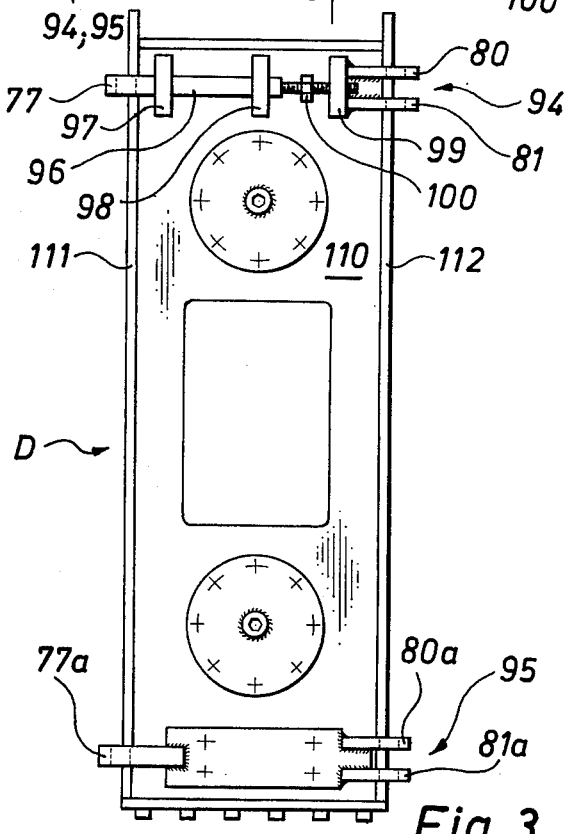
FIG. 3 is a front elevation along arrow L of a portion of the apparatus of FIG. 2.

Profiling units A-E are disposed in such a way that the various rolls 15 and 16 of the operating units form and define an arcuate path. The profiling units are interconnected at the inside of the arc by upper and lower hinge joints 94 and 95, respectively, of which, in FIG. 3, only the parts of the joints on the two sides of profiling unit D have been illustrated. Similar joints exist between the various adjacent ones of the profiling units. Hinge joint 94 includes a bearing holder 77 which is slidable in a horizontal direction with respect to one side of the unit, and, at the other side of the unit, the hinge includes two bearing holders 80 and 81 which are fixedly attached to the unit, one above the other. Holders 80 and 81 are spaced apart to receive the bearing holder 77 of the adjacent unit, this constituting the pivot point of the hinge joint, the bearing holders being interconnected with a bearing bolt 82. Bearing holder 77 is attached to one of a rod 96 which is longitudinally slidable in bearing supports 97 and 98 which are attached to wall 110. A threaded spindle 100 is oppositely threaded at its ends, in the manner of a turnbuckle screw, and threadedly engages an opening in a connecting element 99 between holders 80 and 81. The other end of spindle 100 threadedly engages a threaded opening in the end of rod 86. As will be recognized, bearing holder 77 can be adjusted relative to bearing holders 80 and 81 by rotating threaded spindle 100, for which purpose an enlarged, nut-like middle portion is provided.

Joint 95 is provided with two fixedly attached bearing holders **80*a* and 81*a* on one side of the unit and a fixedly attached bearing holder 77*a* on the other side, which fits between bearing holders 80 and 81*a* on the adjacent unit. Bearing holders 80*a* and 81*a* of profiling unit D are connected with the bearing holder 77*a* of profiling unit C by means of a bearing bolt which, with clearance, passes through bearing holders 77*a*, 80*a* and 81*a* so that the upper bearing holder 77 can be shifted in a horizontal direction in relation to the lower bearing holder 77*a*.**

Lateral walls 111 and 112 are provided with extensions **111*a* and 112*a* on their outer or rear sides. A tubular or pipe-shaped spacer 101 is disposed between the rear side extensions of two adjacent profiling units and a screw bolt 102 passes through extensions 112*a* and 111*a* and through the tubular spacer 101 between two adjacent units. A spring, such as a plate spring 104, can be clamped inbetween nut 103 screwed onto the threaded end of the bolt and the extension 111*a* and 112*a*.**

As will be seen, the length of spacer 101 determines the appropriate distance between extensions **11*a* and 12*a* of two adjacent processing units. The spacers 101 between adjacent ones of profiling units A-E are the same so that the profiling positions between the profiling roller pairs determine an arc the diameter of which depends upon the predetermined lengths of the spacers 101. Thus, the profiling station 6** can be easily adapted to the appropriate desired diameter of the pipe which is to be formed.

Whenever a metal sheet is used which is bent in its plane, viewed in the longitudinally extended position of the sheet, there exists a danger that the wall of the silo being formed will be cone-shaped. This danger can be avoided by adjustment of the bearing holder 77 by operating threaded spindle 100 so that sufficient clearance for the adjustment of bearing holder 77 exists in the joint 95 so that sheets bent in their plane are made straight. The adjustment, which, for example, can be made in the middle profiling unit C in relation to its adjacent profiling unit D, can be sufficient to achieve this desired result.

A sheet guide 106 is series connected to the profiling unit A and a profile-correcting arrangement 107 is series connected to the profiling unit E.

Turning now to rabbeting station 7, the adjacent walls of units F-K are similarly connected at the top and bottom portions thereof by means of locally fixed joints 94 and 95. The spacer means disposed at the radially outward limits of these devices is made as a rigid connecting rail 90 which will be described hereinafter in connection with FIGS. 7. The arcuate path determined by the processing positions of the pairs of rabbeting rolls 57 can be changed by changing the spacers 90. Counter rolls 42 disposed on the inside of the pipe being formed are assigned to the pairs of rabbeting rolls. Each one of the rabbeting units has a driving motor 71. The no-load unit H has no rabbeting rolls but is provided only with a counter roll. Roller means 108 for guiding the sheet into the rabbeting station precedes station 7.

Figure 4:
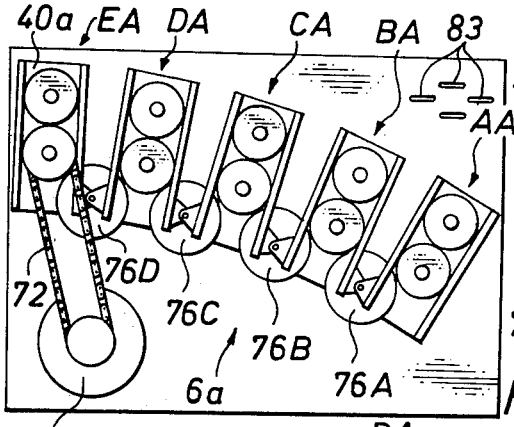
FIG. 4 is a plan view similar to FIG. 2 of a further embodiment of an apparatus according to the invention.
Figure 6:
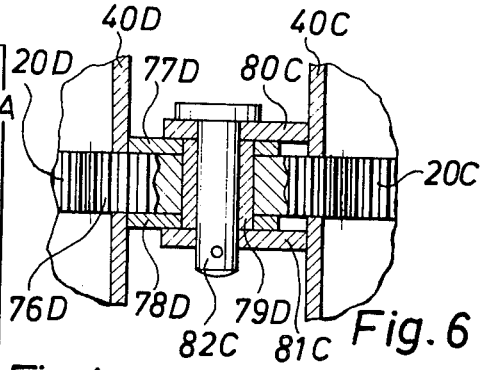
FIG. 6 is a front elevation, in partial section, along line VI—VI of FIG. 5.
Figure 5:
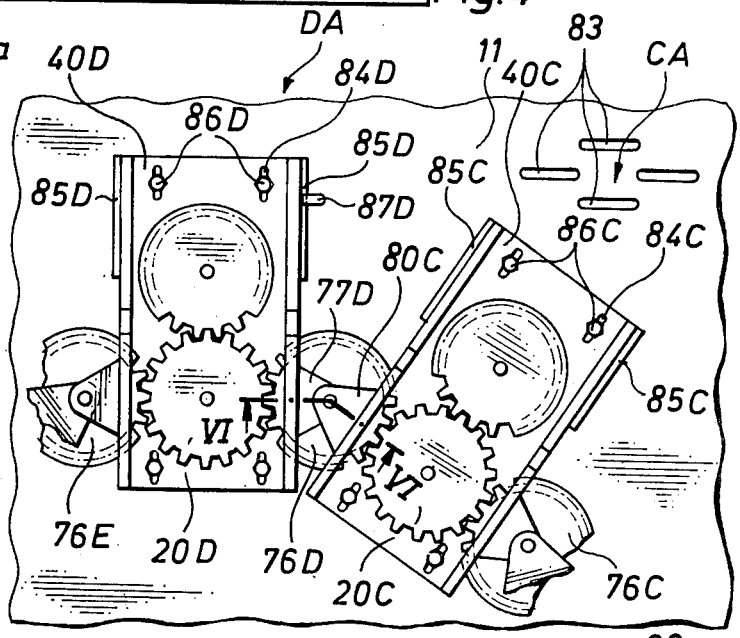
FIG. 5 is an enlarged plan view of a portion of the apparatus of FIG. 4.

A further embodiment of an apparatus according to the invention is shown in FIGS. 4–6 wherein the profiling station indicated generally at **6*a* is mounted on a base plate 11 which is inclined to correspond to the pitch of the sheet 5 in the area of the profiling station and can be adjusted correspondingly. This pitch corresponds to the spiral form determined by supporting rolls 3. The supporting rolls are disposed distributed over the periphery of the annular frame 1 with the pitch corresponding to the width of the sheet 5, less the shaped edge sections. Plate 11** has legs which can be adjusted in length for adaptation for the appropriate desired pitch and which are capable of being adjusted to the desired length.

The profiling units AA, BA, CA, DA and EA are illustrated for the sake of simplicity essentially as cooperating pairs of rolls with double lines disposed laterally thereof indicating the housings. The housings 40*a* of these units are manufactured essentially the same as the housings 40 of the previously described embodiment. Each housing 40*a* is attached at its bottom portion to base plate 11 in a manner to be described. A driving motor 71*a* drives the units of profiling station 6*a*, the motor also being mounted on base plate 11. The motor drives a sprocket wheel, not shown, which is rotatably mounted coaxially with one of the profiling rolls of profiling unit DA by way of a chain 72. A gear is fixed to the same shaft and is rotatable therewith, the gear meshing with an intermediate gear 76D. The intermediate gear, in turn, meshes with a gear arranged coaxially on a shaft with one of the rolls of profiling unit DA. Between profiling units DA and CA another intermediate gear 76C is similarly arranged. Thus, through gears coaxially related to one of each pair of driving rolls coupled with intermediate gears 76B and 76A, the entire plurality of units in the profiling station is driven.

The intermediate gears 76A–D are mounted as more clearly shown in FIGS. 5 and 6. Two bearing holders 77D and 78D are attached on housing 40D with gear 76D located therebetween. The gear is held by means of a bearing rib 79D attached between the bearing holder 77D and 78D. Two bearing holders 80C and 81C are attached to housing 40C in parallel relationship and spaced apart so that bearing holders 80C and 81C, as shown in FIG. 6, overlap the bearing holders 77D and 78D. A bearing bolt 82C which can be secured in its position is pushed through openings in the bearing holders 80C and 81C and through bearing rib 79D. This bearing bolt 82C constitutes a swiveling joint and defines a pivot axis between the two rabbeting units DA and CA. The connections and driving transmissions between the other profiling units adjacent to one another are constructed in the same way and will therefore not be individually described.

Base plate 11 is provided with means defining a plurality of longitudinal slots 83 which are disposed in parallel relationship with each other. The housing 40D of the profiling unit DA similarly is provided with a plurality of longitudinal slots 84D which are disposed perpendicularly relative to longitudinal slots 83 in the base plate with the profiling station DA in its operative position. Longitudinal slots 83 in plate 11 and longitudinal slots 84D in housing 40D are relatively arranged so that a means of attachment, such as a screw 86D can penetrate through the slots in the housing and the plate to connect the profiling unit to the plate. In a similar fashion, longitudinal slots 84C of unit CA are disposed at an acute angle relativel to longitudinal slot 83 of base plate 11. For the purpose of attaching the housing 40D, the housing also has laterally outwardly extending flanges or edges 85D. Each edge 85D can be overlapped and clamped by an L-shaped attaching means 87D which penetrates one of the longitudinal slots 83 in the base plate. Longitudinal slots 84 and projections 85 are provided on each of the housings 40. Since two adjacent profiling units of the profiling station 6*a* are to be swivelable in relation to one another, the station can be adjusted corresponding to the appropriate desired diameter of the pipe which is to be formed.

Adjustment of two adjacent profiling units of the profiling station 6*a* is also possible if the individual units are driven by means of individual drive chains. The rabbeting station can likewise be disposed on a base plate corresponding to plate 11 and the units can be adjustably attached thereto in the same manner as described with reference to profiling station 6*a.*

Figure 7:
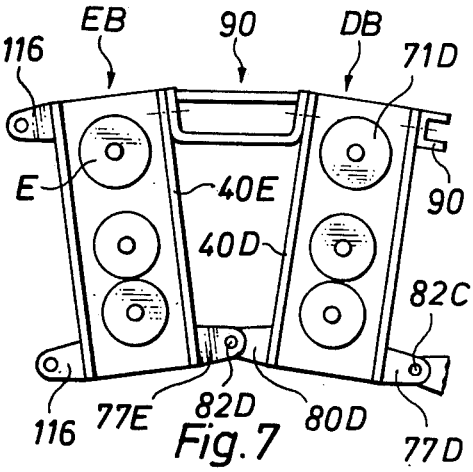
FIG. 7 is a partial plan view of a further embodiment of an apparatus according to the invention.

A further embodiment of profiling units is shown in FIG. 7 wherein units EB and DB are likewise provided with a hinge joint at their opposite walls, which joint has a bearing bolt 82D which penetrates one of the bearing holders 77E attached to profiling unit EB and one bearing holder 80D attached to profile unit DB. As previously described, an additional bearing holder can be assigned to the bearing holder 77E or 80D so that two bearing holders assigned to one unit engage between two other bearing holders assigned to the other unit. The profiling units EB and DB are mutually pivotable about bearing bolt 82D.

As seen in FIG. 7, a connecting rail 90 serves as a fixing or spacing arrangement for determining the angular position between the two profiling units EB and DB, which rail is formed in a U shape as seen from the top, the three legs of the U being connected to one another by braces extending substantially perpendicularly. The legs of the U are at an appropriate angle relative to each other such that this angular relationship is established between the closest walls of the adjacent rabbeting units EB and DB. Connecting rail 90 can be attached to walls 40E and 40D by means such as screws. In order to establish a different angular relationship between the processing units, a different connecting rail 90 would be selected and substituted for the existing rail, the new rail having legs at the appropriate predetermined angle. The connecting rail 90 can be used between adjacent units of either or both of the profiling stations 6 and rabbeting station 7 individual units. The outside processing units of the two stations can be provided with eyes 116 in the area of the bottom, with which they can be attached at the bottom or on a support, such as, for example, the plate 11 discussed with reference to unit 6*a.*

In order to be able to use the connecting rail 90 for different angular positions between adjacent walls of adjacent processing units EB and DB, it is possible to form at least the outside walls of the U-shaped connecting rail in an arched fashion. Such a connecting rail can be disposed at different distances from bearing bolt 82D and thereby determine different angles between the adjacent walls. Preferably, the inside walls of the connecting rails are also formed arched corresponding to the outside surfaces of the same legs.

Whenever a continuous adjustment of the angles between two adjacent walls of adjacent processing units becomes unnecessary, then it is possible to develop the legs of the connecting rails prismatically at least on the outside surfaces, the prismatic surfaces corresponding to the arcuate portion of the arched leg.

Figure 8:
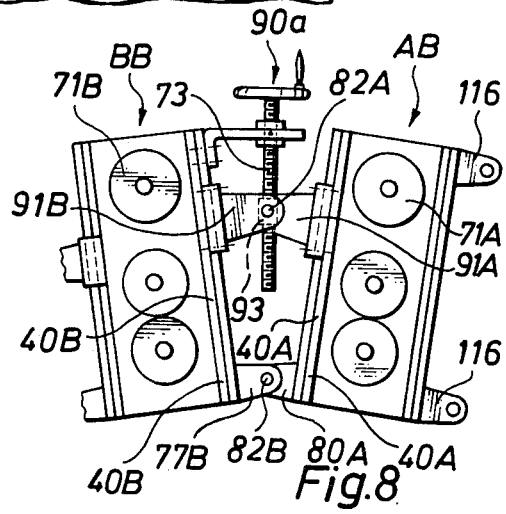
FIG. 8 is an enlarged plan view of a portion of a further embodiment of an apparatus according to the invention.

A further embodiment is shown in FIG. 8 which employs an adjusting arrangement 90*a.* As seen therein, this arrangement includes bearing supports 91B and 91A which are longitudinally slidable on rails attached to walls 40B and 40A, respectively. The bearing supports are interconnected by means of a bearing bolt 82A which has a threaded bushing 93 with an internally threaded opening to receive a driving spindle 73. Spindle 73 is disposed essentially along a line bisecting the angle determined by walls 40B and 40A. Bearing supports 91B and 91A can be shifted along the rails, which can be dovetail guides, and can be fixed by means of screws on the lateral walls 40B or 40A. The threaded spindle 73 is retained in a spindle holder at the end of one of the walls, such as 40B, away from bearing bolt 82B. The spindle holder includes a bearing bushing which is penetrated by threaded spindle 73 and which is internally threaded and swivelable around a perpendicular axis, the axis being substantially parallel with the pivot axis of 82B between the units. Spindle 73 can be adjusted by means of a hand wheel, as illustrated.

It is also possible to accomplish the adjustment without a threaded spindle and sliding guide shown in connection with bearing supports 91B and 91A by attaching those bearings supports to adjacent walls 40B and 40A at predetermined locations which are opposite each other and correspond to each other. Longitudinal slots in the adjacent lateral walls of the processing units serve for the continuous adjustment of the bearing supports.

For the production of a silo, the upper end of metal sheet 5 is formed step-by-step in the profiling station 6. The adjacent edges of the helically-shaped wound sheet are connected with one another by rabbeting in the rabbeting station 7. Penetrations in the lateral walls of the processing units A-K are provided for the passage of the metal sheet. That portion of the pipe which is already produced and which is located outside of the profiling station 6 and the rabbeting station 7 is supported by supporting rolls disposed in the form of a helix, which supporting rolls engage at the lower part of the rabbet overlapping its wall.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for helically winding sheet metal to form a large diameter pipe comprising means for forming and interconnecting adjacent edges of the sheet by rabbeting, said means including a profiling station and a rabbeting station, each of said stations including a plurality of processing units and each of said units having pairs of processing rolls for forming said edges, said pairs of rolls being disposed along an arcuate path, said units in each station being serially arranged to sequentially form said edges;

drive means for driving said rolls;

hinge means interconnecting adjacent ones of said units for relative pivotal adjustment about substantially parallel axes; and means connected to said units for adjusting the angular relationship between adjacent ones of said units comprising a threaded spindle rotatable about an axis perpendicular relative to said substantially parallel axes and threadedly engaging adjacent ones of said units.

2. An apparatus according to claim 1 wherein said threaded spindle is oppositely threaded at its ends, one of said ends threadedly engaging a hinge portion fixedly connected to a unit and the other of said end threadedly engaging a hinge portion movable relative to said unit at an angle to the pivot axis of said hinge means.

3. An apparatus for helically winding sheet metal to form a large diameter pipe comprising means for forming and interconnecting adjacent edges of the sheet by rabbeting, said means including a profiling station and a rabbeting station, each of said stations including a plurality of processing units and each of said units having pairs of processing rolls for forming said edges, said pairs of rolls being disposed along an arcuate path, said units in each station being serially arranged to sequentially form said edges;

drive means for driving said rolls;

hinge means interconnecting adjacent ones of said units for relative pivotal adjustment about substantially parallel axes;

means connected to said units for adjusting the angular relationship between adjacent ones of said units; and rigid spacer means releasably connected between adjacent ones of said units at points spaced from said hinge means.

4. An apparatus according to claim 3 wherein said spacer means includes a bushing, a bolt passing through said bushing, a nut on said bolt and a spring between said nut and said bushing.

5. An apparatus according to claim 3 wherein said spacer means comprises a connecting rail extending between adjacent units, said rail being connectable at a plurality of angles relative thereto.

6. An apparatus for helically winding sheet metal to form a large diameter pipe comprising means for forming and interconnecting adjacent edges of the sheet by rabbeting, said means including a profiling station and a rabbeting station, each of said stations including a plurality of processing units and each of said units having pairs of processing rolls for forming said edges, said pairs of rolls being disposed along an arcuate path, said units in each station being serially arranged to sequentially form said edges;

drive means for driving said rolls;

hinge means interconnecting adjacent ones of said units for relative pivotal adjustment about substantially parallel axes; and means connected to said units for adjusting the angular relationship between adjacent ones of said units, said means for adjusting including second hinge means for pivotally connecting adjacent units;

means for mounting said second hinge means for sliding movement along said units; and means for adjusting the location of said second hinge means relative to said first hinge means.

7. An apparatus according to claim 6 wherein said means for adjusting the location of said second hinge means includes a threaded spindle;

a threaded bushing mounted on and movable with said second hinge means, said spindle passing through said bushing;

bearing means mounted on one of said units for rotatably supporting said spindle, said bearing means being pivotable about an axis parallel to the pivot axis of said second hinge means.

8. An apparatus for helically winding sheet metal to form a large diameter pipe comprising means for forming and interconnecting adjacent edges of the sheet by rabbeting, said means including a profiling station and a rabbeting station, each of said stations including a plurality of processing units and each of said units having pairs of processing rolls for forming said edges, said pairs of rolls being disposed along an arcuate path, said units in each station being serially arranged to sequentially form said edges;

drive means for driving said rolls;

hinge means interconnecting adjacent ones of said units for relative pivotal adjustment about substantially parallel axes; and means connected to said units for adjusting the angular relationship between adjacent ones of said units, said pairs of rolls in two adjacent units including pairs of gear means coaxially connected to said rolls for driving said rolls, and wherein said drive means includes an intermediate drive gear in meshing relationship with one gear means of one roll in each of said two units, said intermediate gear being rotatable about the pivot axis of said hinge means,

9. An apparatus according to claim 8 wherein said hinge means includes support elements projecting from each of said units in overlapping relationship;

said support elements being spaced apart to define a space for said intermediate gear; and a coupling element having a central axis defining said pivot axis passing through said support elements and said gear.

10. An apparatus for helically winding sheet metal to form a large diameter pipe comprising means for forming and interconnecting adjacent edges of the sheet by rabbeting, said means including a profiling station and a rabbeting station, each of said stations including a plurality of processing units and each of said units having pairs of processing rolls for forming said edges, said pairs of rolls being disposed along an arcuate path, said units in each station being serially arranged to sequentially form said edges;

drive means for driving said rolls;

hinge means interconnecting adjacent ones of said units for relative pivotal adjustment about substantially parallel axes; and means connected to said units for adjusting the angular relationship between adjacent ones of said units;

and wherein each of said stations further includes a flat mounting plate for supporting said units;

means in said plate defining a plurality of elongated holes;

means in each of said units defining elongated holes;

attachment means selectably placeable in said holes in said plate and said units to adjustably define the operating positions of said units.

11. An apparatus according to claim 10 wherein said attachment means includes a laterally extending flange connected to each of said units and clamping means for gripping said flange.

* * * * *